US006619378B1

(12) United States Patent
Gavin

(10) Patent No.: US 6,619,378 B1
(45) Date of Patent: Sep. 16, 2003

(54) LOST CORE METHOD OF MOLDING GEMSTONE SEATS

(75) Inventor: John P. Gavin, Keene, NH (US)

(73) Assignee: Findings Incorporated, Keene, NH (US)

( * ) Notice: Subject to any disclaimer, the term of this patent is extended or adjusted under 35 U.S.C. 154(b) by 17 days.

(21) Appl. No.: 09/846,853

(22) Filed: May 1, 2001

(51) Int. Cl.[7] ..... B22C 9/00
(52) U.S. Cl. ..... 164/516; 164/24
(58) Field of Search ..... 164/24, 516, 517, 164/518, 519

(56) References Cited

U.S. PATENT DOCUMENTS

| | | | | |
|---|---|---|---|---|
| 450,618 A | | 4/1891 | Hogg | |
| 980,060 A | | 12/1910 | Buser | |
| 2,035,244 A | | 3/1936 | Pejchar | |
| 3,562,900 A | | 2/1971 | Buehler | |
| 3,601,178 A | * | 8/1971 | Marticorena | 164/45 |
| 3,751,795 A | | 8/1973 | Favre | |
| 4,154,282 A | | 5/1979 | Kull | |
| 4,187,272 A | * | 2/1980 | Bourdon et al. | 264/318 |
| 4,258,458 A | | 3/1981 | Danna | |
| 4,487,246 A | * | 12/1984 | Frasier | 164/32 |
| 5,296,308 A | * | 3/1994 | Caccavale et al. | 428/586 |
| 5,505,250 A | * | 4/1996 | Jago | 164/516 |
| 5,671,613 A | | 9/1997 | Hoover et al. | |
| 5,853,044 A | * | 12/1998 | Wheaton et al. | 164/516 |

* cited by examiner

*Primary Examiner*—J. J. Swann
*Assistant Examiner*—Andrea Chop
(74) *Attorney, Agent, or Firm*—Salter & Michaelson

(57) ABSTRACT

A method for molding gemstone settings using metal molds is provided. The gemstone settings have unitary seats on the prongs of the settings. The method involves using a core pin mold to form a core pin which is interengageable with a metal production mold for the setting. A gemstone setting is also provided, with a substantially smooth inner prong surface. The gemstone setting provides substantially stronger set gems and reduces the incidences of shattering gems during the setting process.

10 Claims, 16 Drawing Sheets

LOST CORE METHOD OF MOLDING GEMSTONE SEATS

BACKGROUND

1. Technical Field

The present invention is directed to a gemstone setting and a method for molding the gemstone setting and, more particularly, to gemstone settings with seats molded directly into the settings and a method for molding seats into gemstone settings using metal molds.

2. Related Art

A variety of gemstone settings (hereinafter "setting" or "settings") are used in the jewelry industry. The selection of settings is usually made to enhance the beauty of a gemstone (hereinafter "gem"). Settings may be hand-carved, molded, or stamped, and may include prongs that frictionally maintain a gem in the setting. Stamped settings are generally less attractive, and less malleable than those formed from other processes due to the deformation of metal inherent in the stamping process.

A typical molded setting 10 is shown for illustrative purposes only in FIG. 1. Setting 10 includes a base indicated generally at 12 having a perimeter 14 from which a plurality of prongs 16 having an inner face 22 extend upwardly and slightly outwardly, terminating at upper prong surface 17. Setting 10 also includes a band 18 approximately midway between the perimeter 14 of base 12 and upper prong surface 17.

In some instances, inner face 22 of prongs 16 may include a "seat" on which a gem may be fitted or into which it "sits." Seats may be hand-carved, stamped, or molded directly into the inner face of the prongs of a setting at the upper end of the prongs. FIG. 2 illustrates such a setting 10*a*, which includes all of the elements of setting 10, and additionally includes a hand-carved seat 24 formed at upper end 20 of prong 16 on the inner surface 22 of each prong 16. An expanded side view of seat 24 is illustrated in FIG. 3, showing a portion 22*a* of inner surface 22 of prong 16 remaining exposed above seat 24 after hand-carving.

A side view of a typical gem 30 is shown in FIG. 4 for illustrative purposes only. Gem 30 includes a table 32, a crown 34, a culet 36, a pavilion 38, and a girdle 40.

FIG. 5 shows a perspective view of a set gem 50 using, for example, gem 30 and setting 10*a*. As shown, gem 30 is "set" by positioning girdle 40 in seats 24 and folding upper ends 20*a* of prongs 16 downwardly toward crown 34 of gem 30. The folding process requires the exertion of a great deal of force in order to ensure that surface 22*a* of prong 16 contacts crown 34, as shown in side view in FIG. 6. If excessive force is exerted during this process, the gem may shatter. Generally, the intersection of crown 34 and girdle 40 at line $L_1$, and the intersection of girdle 40 with pavilion 38 at line $L_2$, are the points or lines of intersection at which the seat directly contacts the gem 30, due to the arcuate shape of hand-carved seats.

Regardless of the method used to form the seats, it is important for aesthetic reasons to ensure that the size and placement of the seats remains substantially the same on each prong of a setting. If the gem is not level with respect to the base of the setting, it will appear crooked to the naked eye. In addition, if the placement of the seats on the prongs of a setting varies, the length of the portion of the prongs (i.e. 22*a*) that is folded onto crown 34 will vary. Both of these are undesirable for aesthetic reasons and consequently for economic reasons.

Hand-carving seats require a great degree of skill and precision on the part of the jewelry maker to ensure that the size and placement of the seats remains substantially the same on each prong. Hand-carved seats have a generally arcuate shape, as shown in FIG. 3. The arcuate shape of hand-carved seats sometimes may be disadvantageous when attempting to "set" a stone in a setting if the carving has penetrated too deeply into the interior face of the prong, or if the placement of the seat on each prong varies.

One method of addressing the foregoing problems involves molding seats directly into the prongs of a setting using what is known as the "rubber molding process." The rubber molding process (RMP) involves forming a master setting using conventional means such as would be known to jewelry makers. The master setting is then encased in rubber, and the rubber is allowed to harden. The rubber mold is then split in half, resulting in two complementary mold halves. An exemplary rubber mold halve 60 is illustrated in side view in FIG. 7. Rubber mold 60 includes a parting surface 62, with a relief pattern formed in mold halve 60, fluidly connected to a sprue 64 and gate 66 for receiving fluid material, each which are known to those of skill in the art. The relief pattern includes a plurality of fluidly connected channels or partial channels corresponding to the structure of the desired setting. For example, channel 68 corresponds to base 14, channel 70 corresponds to band 18, and channels 72 correspond to prongs 16.

Because the rubber can flow around and encase the master setting, the rubber mold process can reproduce all the features of the master setting, including the interior surface of the setting. Section 74 of mold 62 includes a relief pattern of the inner surface of the desired setting. For example, section 74 includes grooves 76 corresponding to the inner surface 22 of setting 10, 10*a*, as well as surface 78 corresponding to hand-carved seat 24. Thus, the relief pattern also represents the inner surface 22 of prongs 16 of setting 10*a*, including seats 24.

When the two complementary rubber mold halves are assembled, for example, by clamping, wax may be injected into the assembled rubber mold to form a wax copy of the master setting. The wax copy may be removed from the mold by disassembling the two rubber mold halves. The wax copy of the master setting may then be used to form a precious metal setting.

The remainder of the rubber molding process involves a "lost core" process which is well know to those of ordinary skill in the art. The lost core plaster method involves casting the wax copy or copies in plaster, heating the plaster above the point at which the wax will decompose or carbonize, and injecting molten metal, typically a precious metal, into the plaster. After the metal has hardened, the plaster casting may be shattered to allow removal of the precious metal copy of the master setting.

Thus, if the master setting includes seats, the seats will be reproduced using the rubber molding process. The rubber molding process may be disadvantageous because the flexibility of the rubber mold makes it easy to slightly misalign or distort the mold halves when assembling the mold and during the molding process. This makes it difficult for the jewelry maker to ensure that the size and placement of the seats remains substantially the same on each prong and to maintain reproducibility between settings formed in this manner. Thus, for example, although it is possible to mold seats directly into settings using the rubber mold process, such seats may be at different positions on each of the prongs, resulting in irregularities in the position of the gemstones. In addition, the dimensional accuracy of the settings produced by this method are less than what is desirable due to the number of iterations required to obtain the desired precious metal copy of the original master, i.e. the precious metal copy is a copy of a wax copy, which in turn is a copy of the master setting. Each subsequent copying step reduces the overall accuracy of the final part in comparison to the master setting.

One attempt to overcome the foregoing problems with the rubber molding process involves using metal molds rather than rubber molds. The metal molding process provides greatly improved reproducibility and accuracy of the final setting in comparison to the rubber molding process. However, because metal molds must be machined, it is impossible to provide two mold halves that include a relief pattern of the interior and exterior of the desired setting. By way of explanation, a typical metal molding process now will be explained with reference to FIGS. 8–15. FIG. 8 shows a perspective view of a mold 100 for forming a setting using metal molds. Mold 100 includes two substantially symmetrical mold halves 100*a,b*, each having a top surface 102*a,b*. Preferably, each mold halve 100*a,b* may be machined from a metal such as brass, using a CAD image of the desired mold. Thus, it can be seen that the metal molding process does not require the formation of a master setting, as does the rubber molding process. This increases the dimensional accuracy of the final settings because fewer copying iterations are required than with the rubber molding process.

As shown in FIG. 9, which is an expanded view of mold 100, each brass mold halve 100*a,b* includes a parting surface 104*a,b*. A substantially frustoconical depression having a surface indicated generally at 106*a,b* is machined in each mold halve 100*a,b*, and is fluidly connected to a sprue 164*a,b* and a gate 166*a,b* for receiving material, each which are known to those of skill in the art. Each surface 106*a,b* includes a relief pattern of fluidly connected grooves corresponding to the outer surface of the structure of the desired setting. For example, grooves 114*a,b* correspond to base 14, grooves 118*a,b* correspond to band 18, and grooves 116*a,b* correspond to prongs 16. Unlike the rubber molding process, it is not possible to machine molds that include a relief pattern of the interior of the desired master setting. For example, inner surface 22 of prongs 16 cannot be machined in mold halves 100*a,b*.

To overcome this problem, a "core pin" is used in conjunction with mold 100. The core pin is formed by pressing a soft metal into mold 100. As shown in FIG. 10, which illustrates core pin 180 after pressing the soft metal into mold 100, the resulting core pin 180 includes a handle portion 182 and a frustoconical pin portion indicated generally at 184. As best shown in FIG. 1, an outer surface 106*p* of the frustoconical pin portions 184 includes a plurality of protrusions that correspond to the grooves of the relief pattern of mold 100*a*. For example, protrusions 118*p* corresponds to grooves 118*a,b*, protrusions 114*p* corresponds to grooves 114*a,b*, and protrusions 116*p* correspond to grooves 116*a,b*. Protrusions 114*p*, 116*p*, and 118*p* are filed away using, for example, a hand file, in order to obtain the core pin 180 shown in FIG. 12, having a substantially smooth exterior surface indicated generally at 106.

After removal of projections 114*p*, 116*p*, and 118*p*, core pin 180 has a substantially smooth exterior surface 106 that mates with the frustoconical interior surface 106*a,b* of mold 100. Thus, when core pin 180 is engaged with mold 100, the regions of core pin 180 from which material was removed define a channel corresponding to the structure of the desired setting. Plastic then may be injected into the mold through the sprue and gate of the mold, as is known in the art. After the plastic has solidified, a plastic copy of the desired master setting may be removed, as shown in FIGS. 13–14, which illustrate an exemplary setting 10 resulting from such a molding process.

Thereafter, the plastic copy 10 of the desired master gemstone setting is cast in plaster and heated to a temperature at which the plastic will melt or carbonize. A molten precious metal then may be introduced into the plaster casting, and upon cooling, the plaster may be cracked to allow removal of the precious metal setting.

Because metal molds are rigid, and less likely to deform during the molding process, the metal molding process provides accurate dimensional reproducibility. However, the metal molding process may be disadvantageous because the tooling required to make the brass mold and the core pin mold is expensive, the labor involved in filing the protrusions from the core pin mold is time consuming and critical, and it is not possible to mold seats directly into the gemstone settings. Thus, the seats must be hand carved into the prongs, which requires a great deal of skill, is labor-intensive, and therefore expensive.

Another attempt to overcome the foregoing problems is disclosed in U.S. Pat. No. 3,601,178 to Marticorena, which discloses a method for forming a unitary ring and gemstone setting using a rubber molding process.

Selective Laser Sintering (SLS) may be used to form molds for complex three dimensional objects that cannot otherwise be formed by machining metal or metal alloys. However, SLS and other related methods are extremely expensive.

Thus, there remains a need in the art for an improved setting and a method for making the settings.

SUMMARY

The present disclosure is directed to a method for molding a gemstone setting having a plurality of prongs, using a metal mold. The method involves machining a first metal core pin mold, pressing a soft metal into the first core pin mold to obtain a core pin, and inserting the core pin into a second metal mold. A fluid non-metal material then may be injected into the second metal mold. The non-metal material may be allowed to harden and may be removed from the second mold to obtain a non-metal setting having a unitary seat disposed on the inner surface of each prong of the setting. The distance between the seat and a base of the setting and the distance between the seat and an end of each prong is substantially the same on each prong.

The method may also involve casting the non-metal setting in plaster, removing the non-metal setting from the plaster to form a plaster mold, introducing a molten metal into the plaster mold, and allowing the molten metal to harden. This allows the removal a metal setting from the plaster mold to obtain a metal setting having a unitary seat disposed on the inner surface of each prong of the setting.

The prong of the setting may include a substantially smooth inner surface interrupted by a step, and the step forms at least a portion of the seat.

The core pin mold may include an interior surface defined by a frustum, with the interior surface of the frustum including a step disposed a predetermined distance from the base of the frustum.

The step of pressing a soft metal into the core pin mold involves forming a core pin having a handle portion and a frustum extending from the handle portion. The frustum has an outer surface interrupted by a continuous step disposed about the frustum. The step is disposed a predetermined distance from the base of the frustum.

In some embodiments, the step may be perpendicular to the outer surface of the frustum.

The disclosure is also directed to a molded gemstone setting having a plurality of prongs in which a gemstone having a girdle and a crown is disposed. The gemstone setting includes a base having a perimeter and a plurality of prongs extending upwardly from the perimeter of the base. Each prong has an upper surface, a substantially flat inner surface, and a substantially arcuate outer surface. A seat defined at least partially by a step may be disposed on the inner surface of each prong between the base and the upper surface of each prong, the thickness of each prong. The step may be substantially the distance from the step to the upper surface of each prong. The seat may be constructed and arranged to position the girdle of the gemstone substantially parallel to the base of the gemstone setting. The inner surface of the prongs above the step may be constructed and arranged to substantially conform to the girdle and crown of the gemstone when the prongs of the setting are folded toward the crown of the gemstone.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE PREFERRED EMBODIMENTS

The present disclosure is related to a method of molding a setting with unitary seats using metal molds, and to the settings produced thereby. The method eliminates the need to hand-carve or otherwise form seats in the prong. The method provides repeated, dimensionally accurate reproductions of the desired setting.

Figure 15:
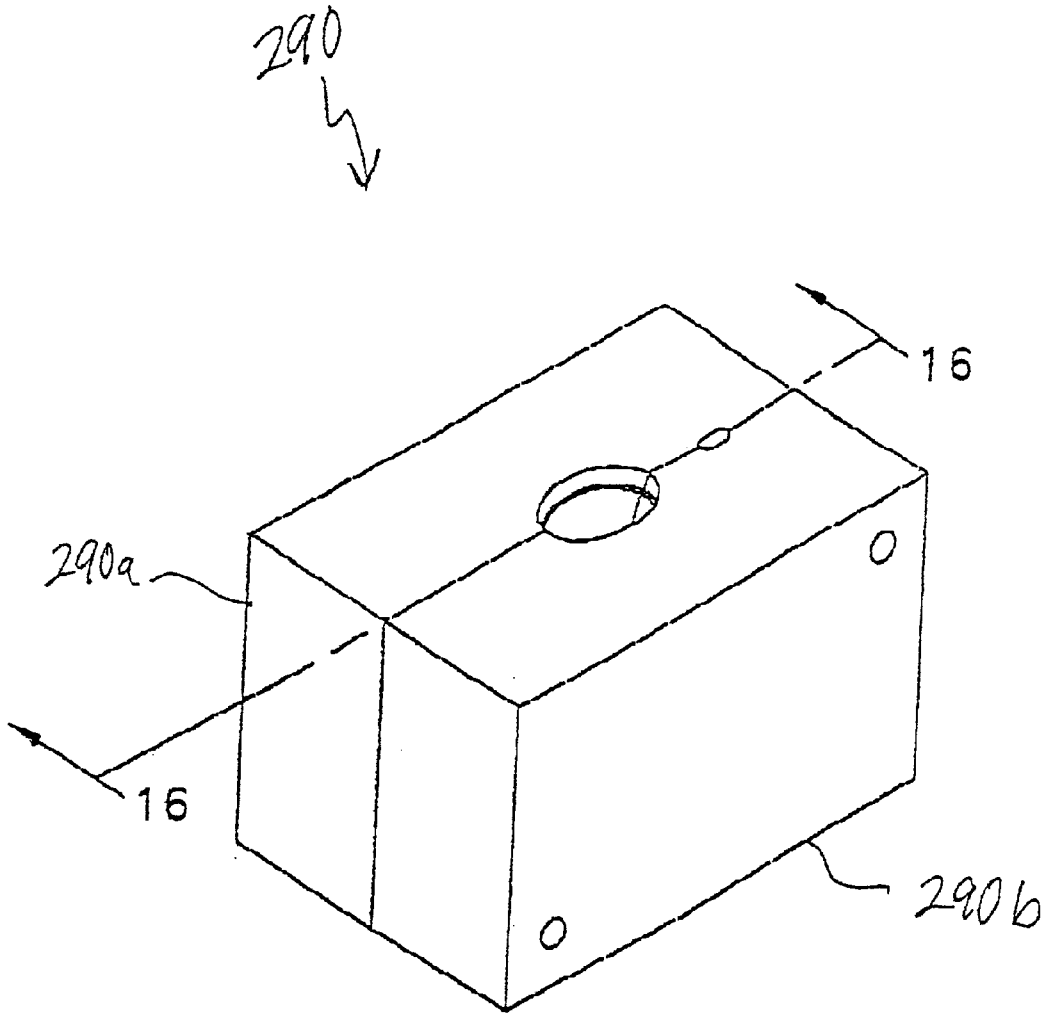
FIG. 15 is a perspective view of a core pin mold according to the present disclosure.
Figure 16:
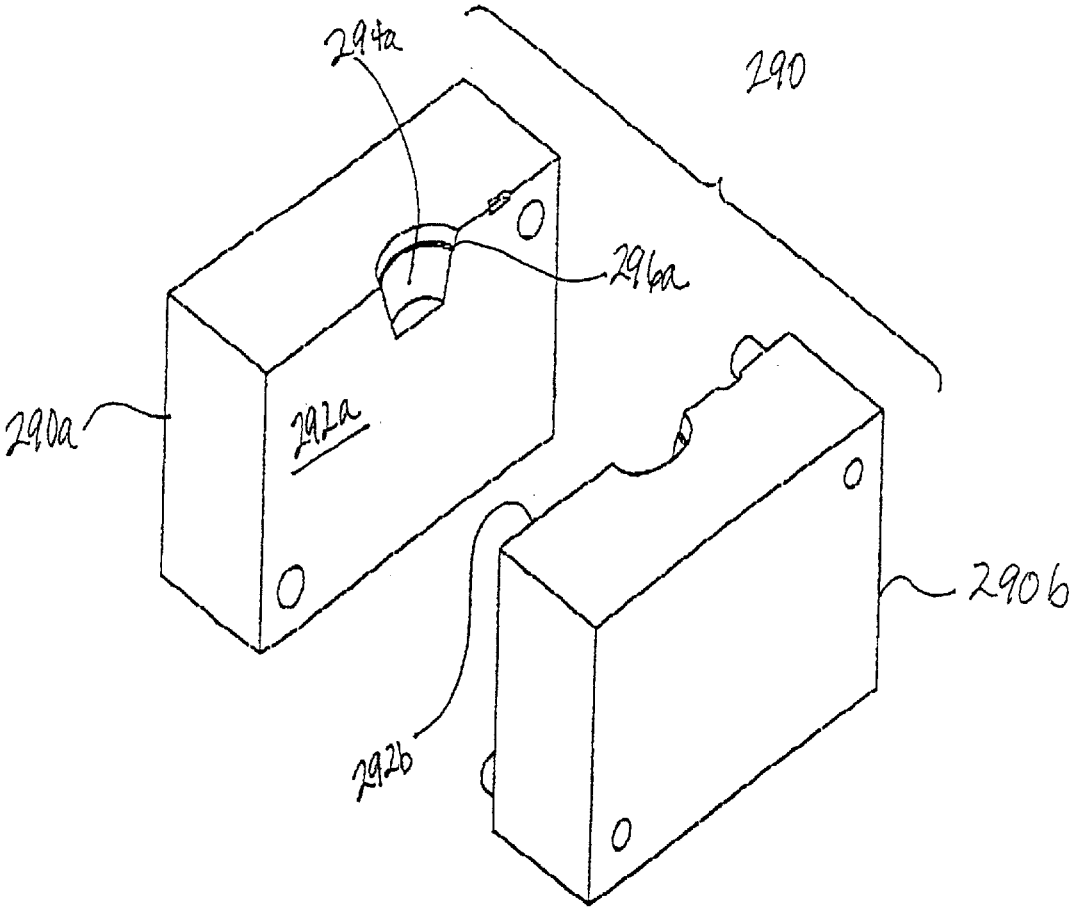
FIG. 16 is an exploded perspective view of the core pin mold shown in FIG. 15 along line 16—16.

The method involves machining a metal core pin mold for forming a core pin. Preferably, the core pin mold may be formed by machining a metal, such as brass, using a CAD design of the desired core pin mold. FIGS. 15 and 16, when viewed together, show a core pin mold 290 according to the present disclosure. As shown, core pin mold 290 includes two substantially symmetrical mold halves 290*a,b*. In general, mold halves illustrated herein are symmetrical in construction. Therefore, where applicable, corresponding features on each mold halve are indicated by the suffix a, or b, even though not illustrated in the figures. Each core pin mold halve 292*a,b* includes a parting surface 292*a,b*. A substantially frustoconical depression indicated generally at 294*a,b* is machined into each mold halve 290*a,b*.

Figure 17:
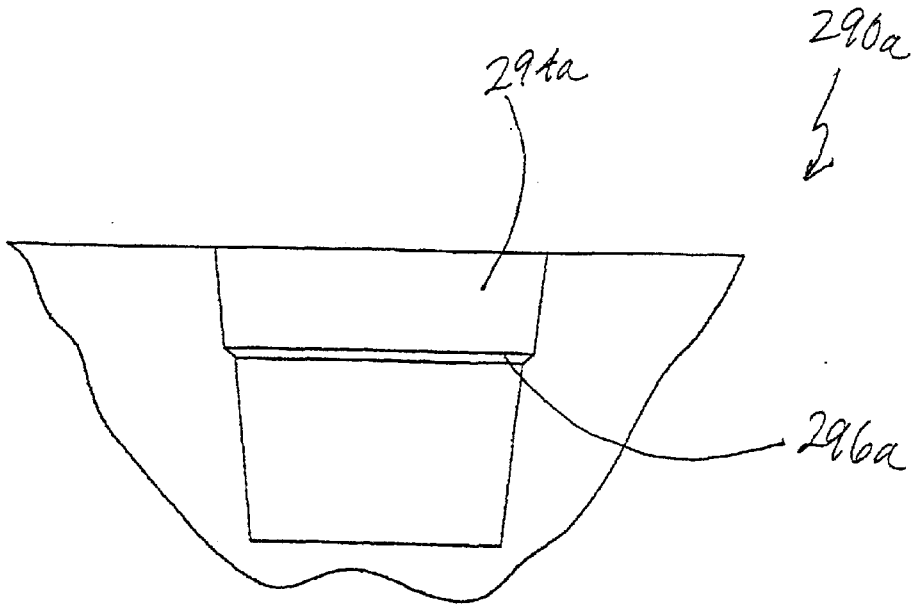
FIG. 17 is an expanded side view of the core pin mold shown in FIGS. 15–16 showing the relief pattern in the mold.

As shown in expanded view in FIG. 17, a step 296*a,b* is also machined into frustoconical surface 294*a,b*. Steps 296*a,b* are used to form seats, as will be described in greater detail below.

Figure 18:
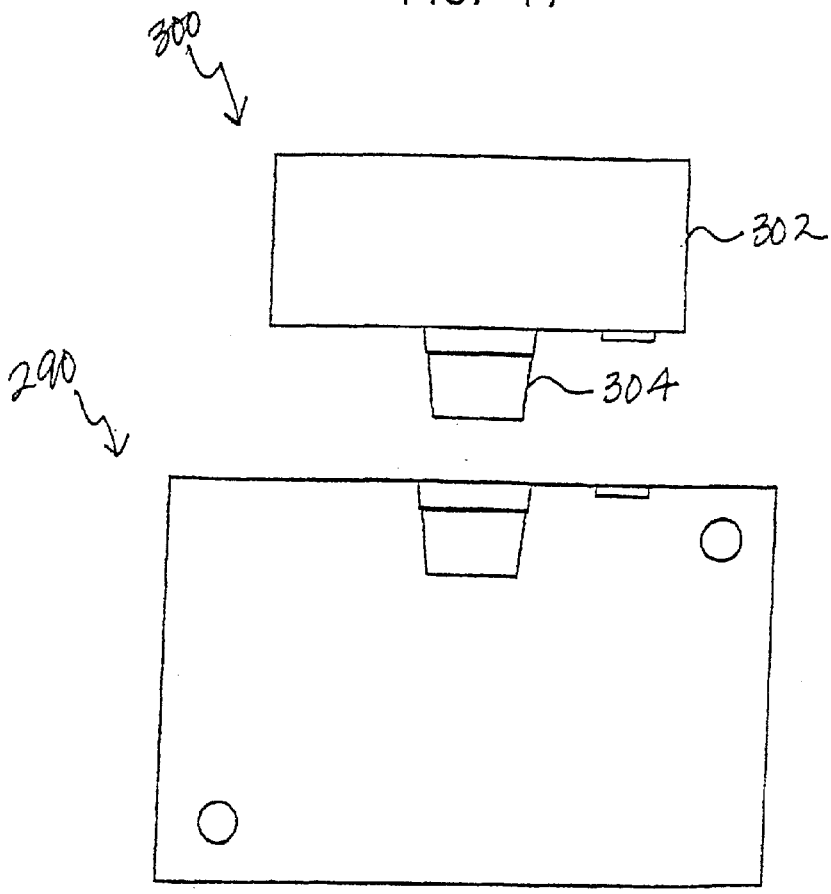
FIG. 18 is a side view of the soft metal core pin after pressing into the core pin mold shown in FIGS. 15–17.

The core pin of the present disclosure may be obtained by pressing a soft metal plug into core pin mold 290. FIG. 18 illustrates the resulting core pin 300 after removing the soft metal from core pin mold 290.

Figure 19:
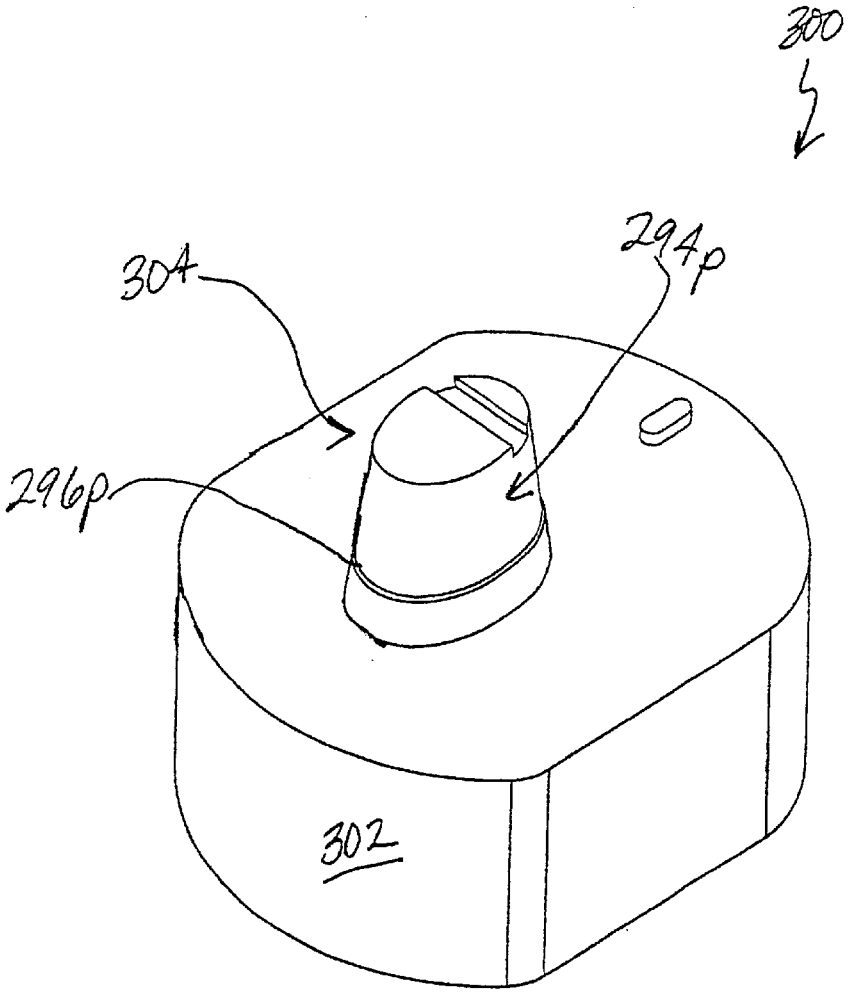
FIG. 19 is a bottom perspective view of the core pin shown in FIG. 18.

As shown best in FIG. 19, core pin 300 according to the present disclosure includes a handle portion 302 and a frustum indicated generally at 304. Frustum 304 has a generally smooth outer surface indicated generally at 294*p*, interrupted by a step 296*p*.

Figure 8:
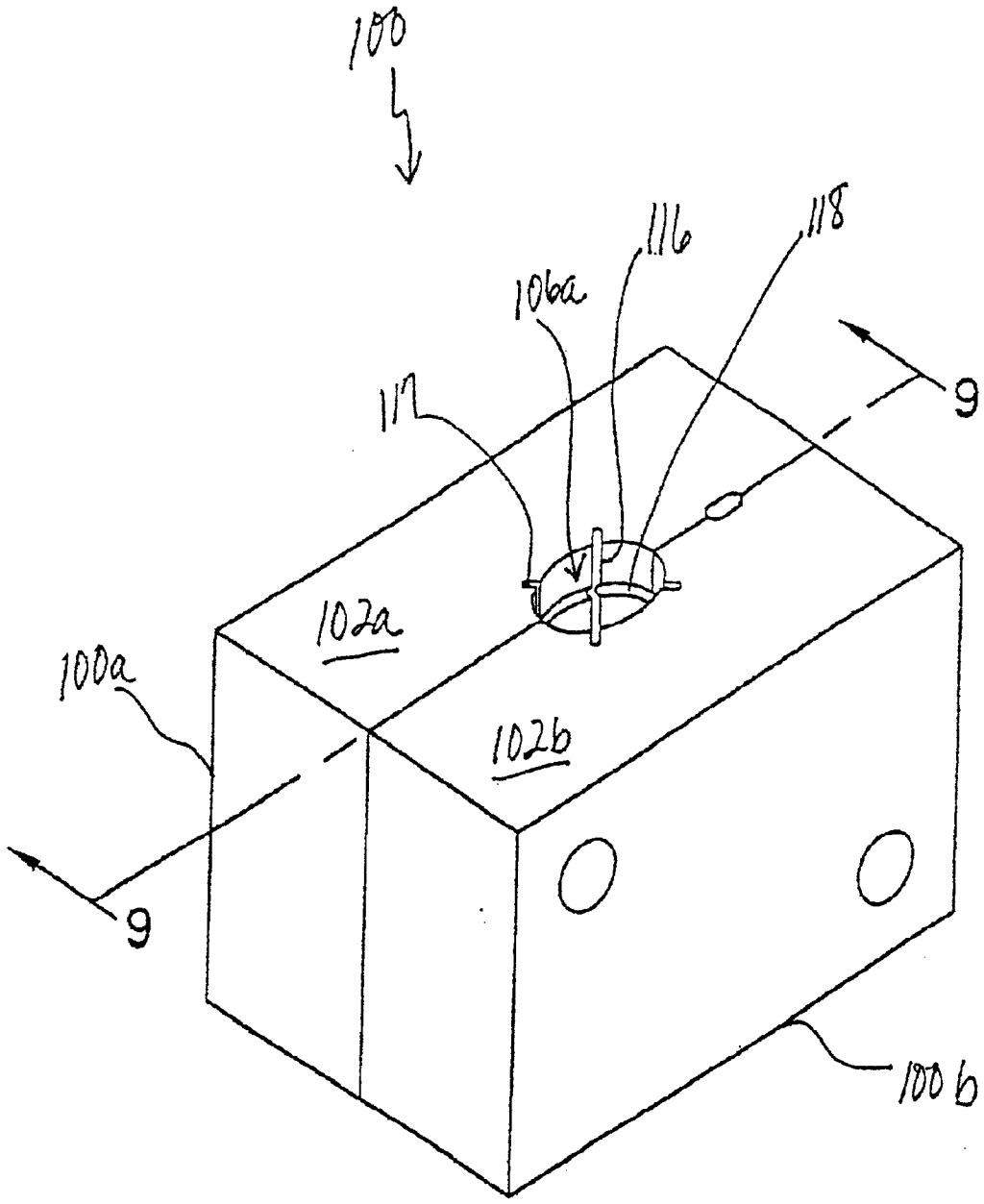
FIG. 8 (PRIOR ART)
FIG. 8 is a perspective view of a metal mold used to form a setting.
Figure 9:
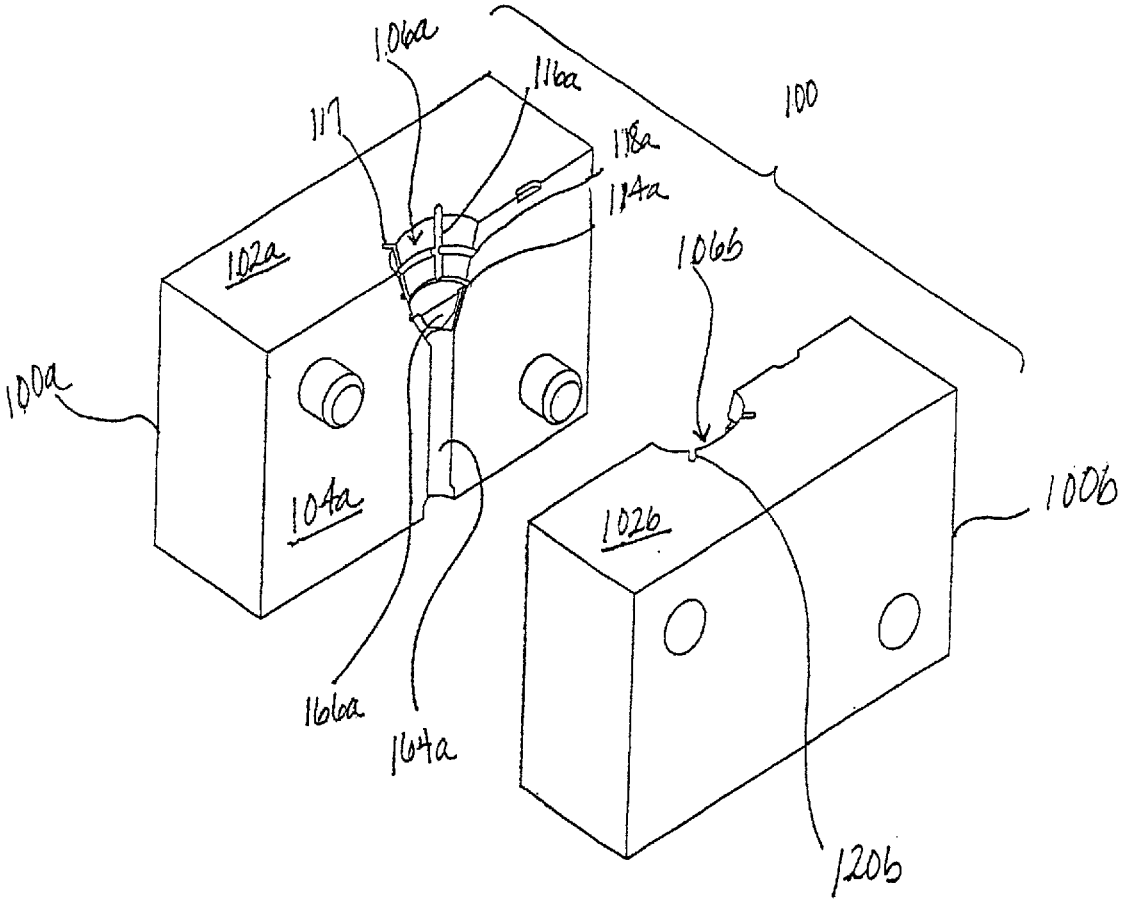
FIG. 9 (PRIOR ART)
FIG. 9 is an exploded perspective view of the mold shown in FIG. 8 along line 9—9.
Figure 10:
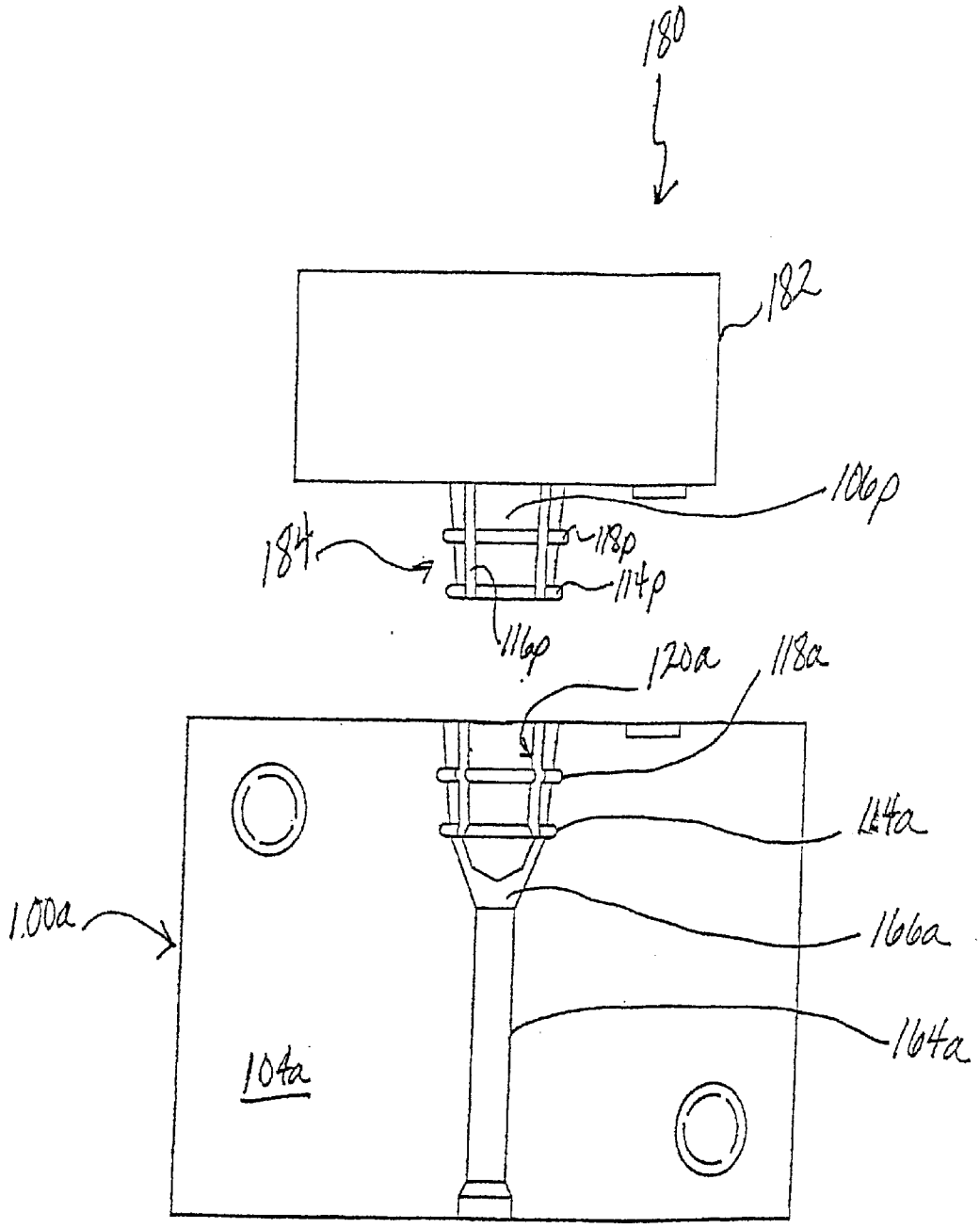
FIG. 10 (PRIOR ART)
FIG. 10 is a side view showing the core pin after pressing into the mold shown in FIGS. 8 and 9.
Figure 11:
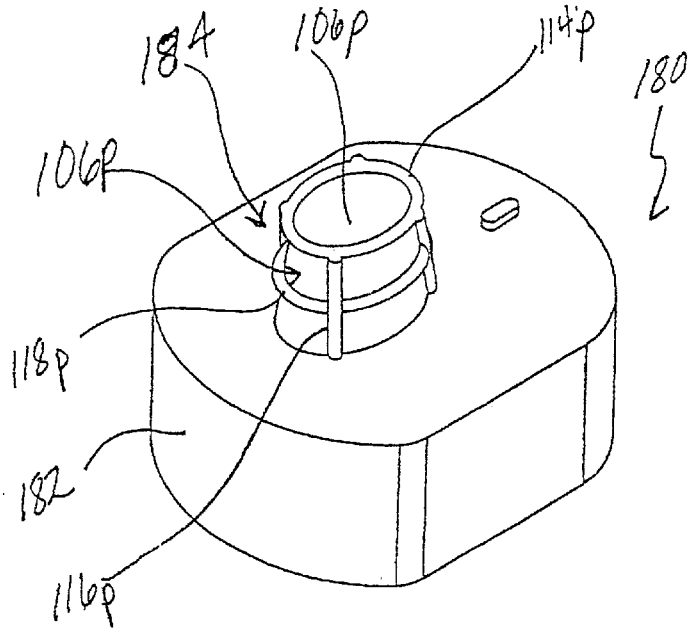
FIG. 11 (PRIOR ART)
FIG. 11 is a perspective view of the core pin shown in FIG. 10.
Figure 12:
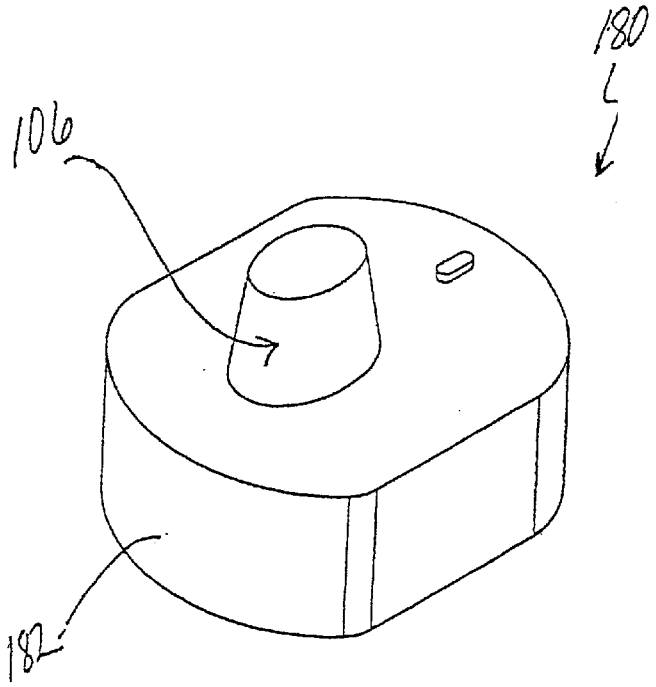
FIG. 12 (PRIOR ART)
FIG. 12 is a perspective view of the core pin shown in FIG. 11 after filing to remove the surface projections produced during the pressing operation.
Figure 13:
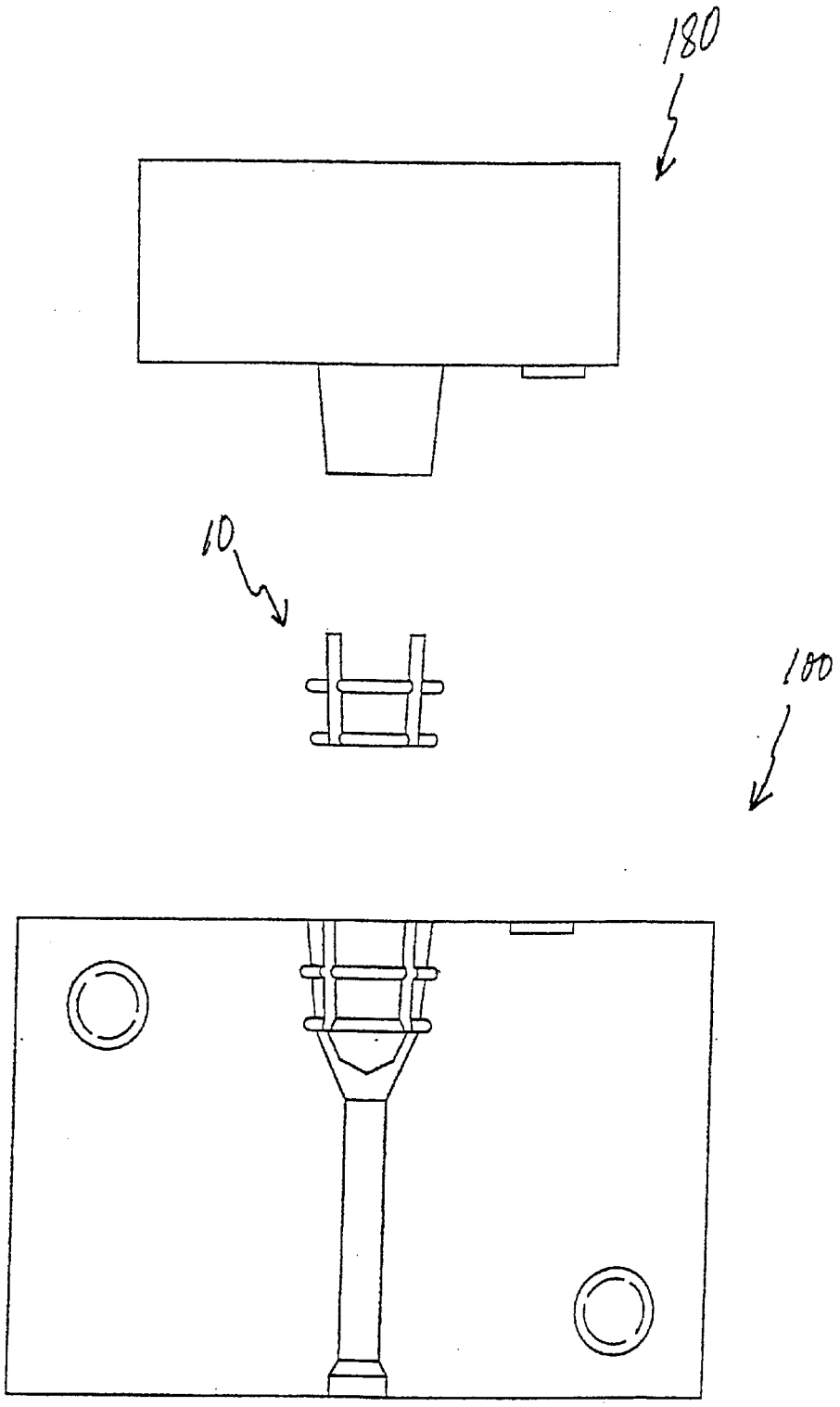
FIG. 13 (PRIOR ART)
FIG. 13 is a side view showing the relationship of the core pin shown in FIGS. 10–12 with the metal mold shown in FIGS. 8–9, with the resulting setting produced from the molding process disposed between the core pin and the metal mold.
Figure 14:
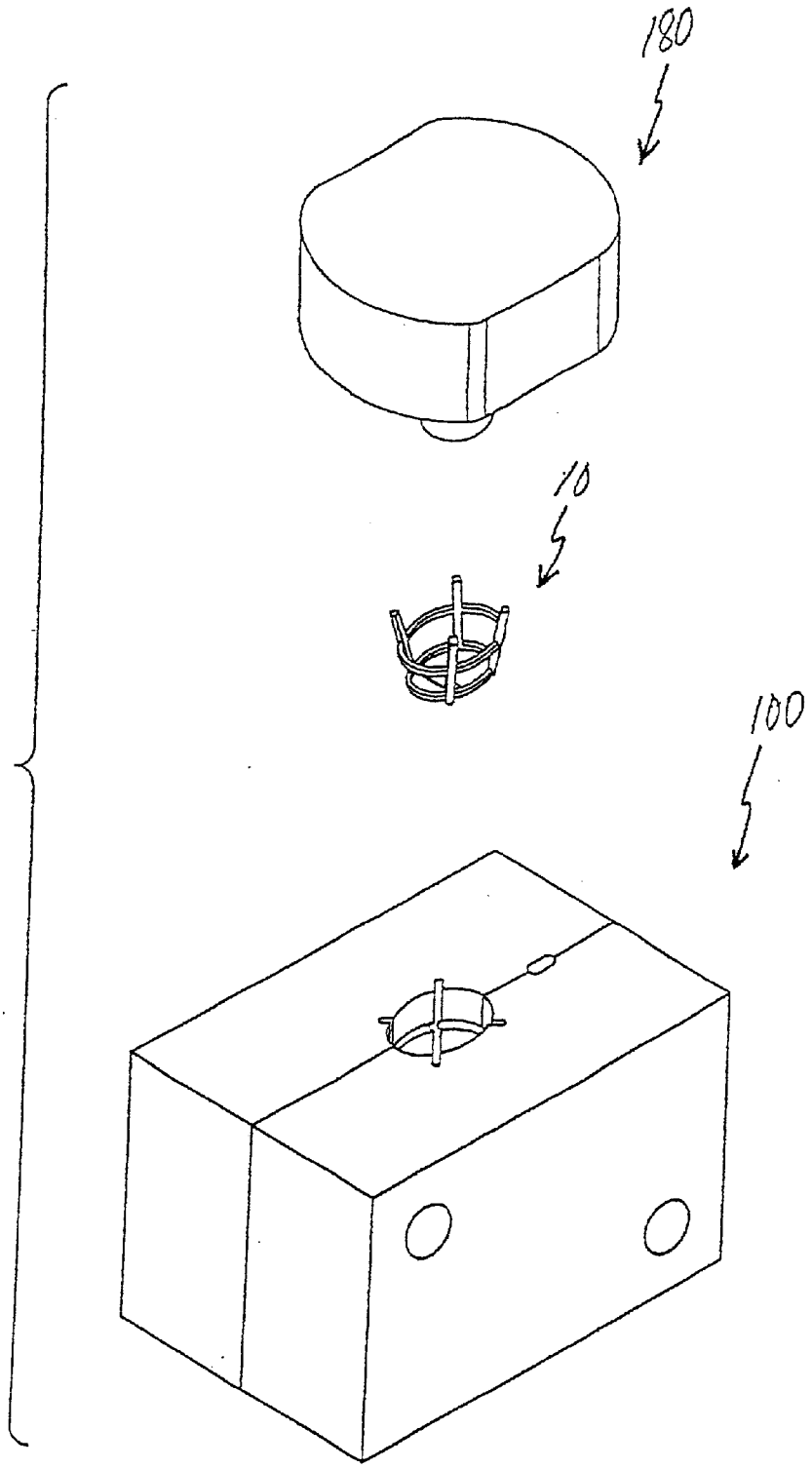
FIG. 14 (PRIOR ART)
FIG. 14 is an exploded perspective view showing the relationship of the core pin shown in FIGS. 10–12 with the metal mold shown in FIGS. 8–9, with the resulting setting produced from the molding process disposed between the core pin and the metal mold.
Figure 20:
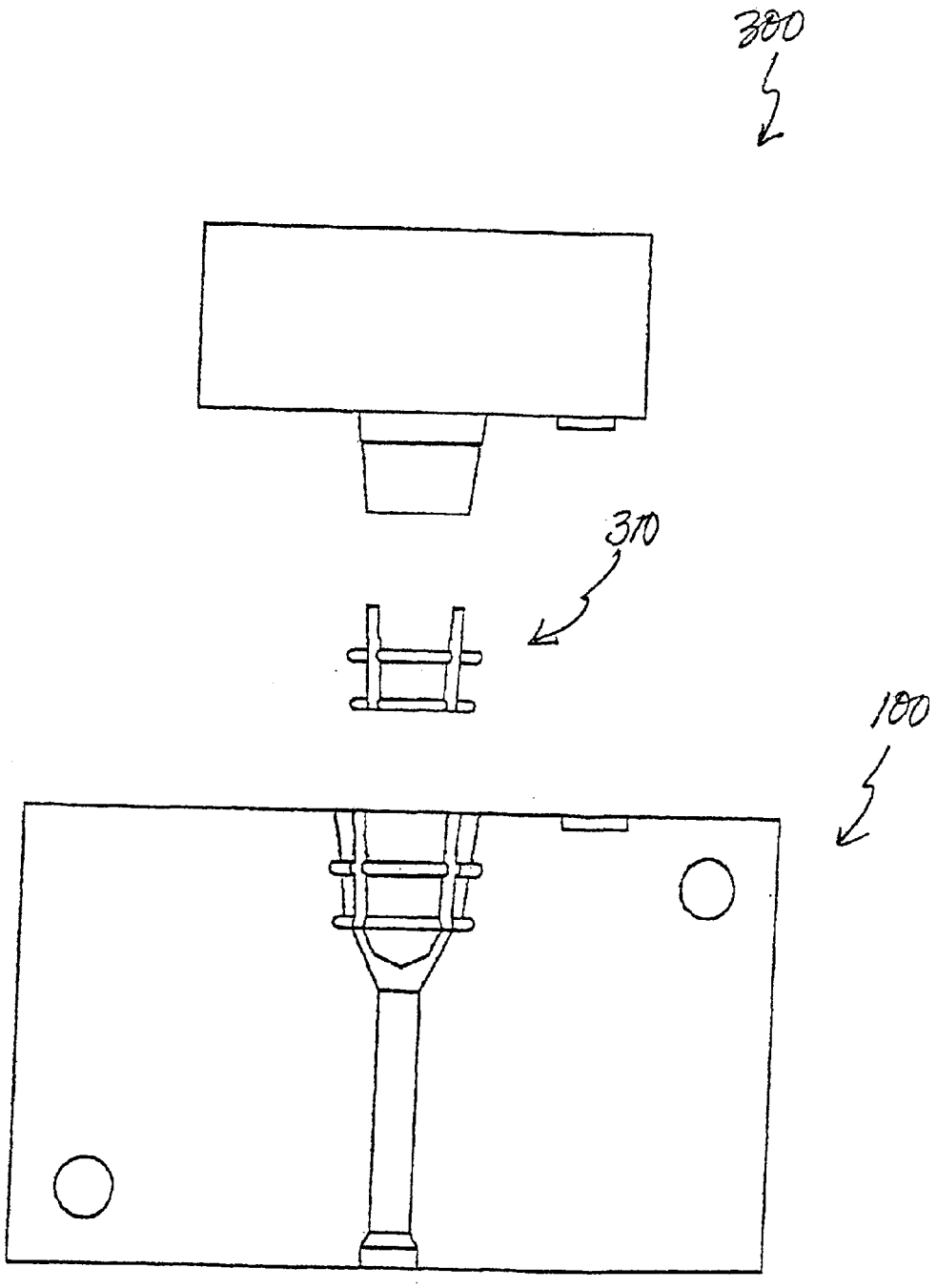
FIG. 20 is a side view showing the relationship of the core pin shown in FIGS. 18–19 with the metal mold shown in FIGS. 8–9, with the resulting setting produced from the molding process disposed between the core pin and the metal mold.

Core pin 310 may be inserted into a suitable production mold, without requiring any the removal of any material or any additional machining before use. Using metal mold 100 (see FIGS. 8–9) for illustrative purposes only, when the two complementary metal mold halves 100*a,b* are assembled, for example, by clamping, and core pin 310 is inserted into mold 100, a channel is defined corresponding to the structure of the desired setting. Plastic then may be injected into metal mold 100 through sprue 164 and gate 166 of mold 100 to form a plastic copy of the desired master setting. FIG. 20 illustrates the relationship of core pin 300 with mold 100, and the resulting plastic copy of the desired master setting 310 obtained after this step in the molding process.

The plastic copy may be removed from the mold by removing the core pin and disassembling the two metal mold halves. The plastic copy of the master setting may then be used to form a precious metal setting using methods well known to those of skill in the art. For example, the plastic copy of the master setting may be cast in plaster and heated above the point at which the plaster will decompose or carbonize. After the plastic has carbonized, a channel remains in the plaster corresponding to the desired master setting. Thereafter, a molten metal, typically a precious metal, may be introduced into the channel in the plaster. After the metal has hardened, the plaster casting may be shattered to allow removal of the precious metal copy of the master setting.

Figure 21:
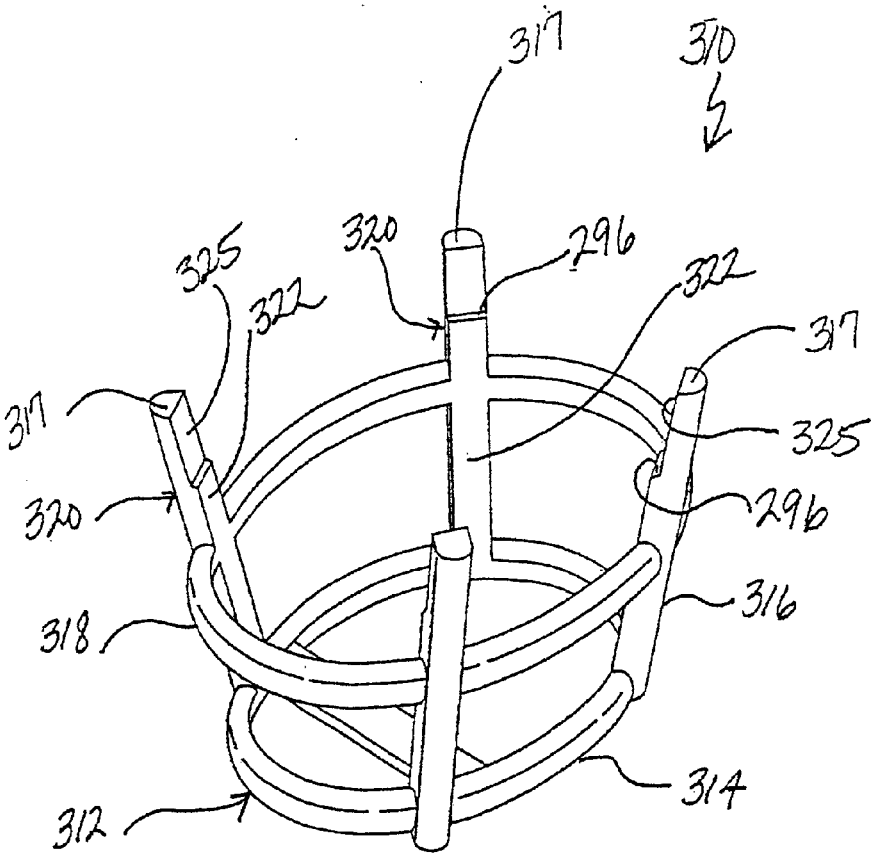
FIG. 21 is a perspective view of the resulting setting obtained using the core pin shown in FIGS. 18–19 with the metal mold shown in FIGS. 8–9.

As best shown in FIG. 21, setting 310 includes a base 312 having a perimeter 314 from which a plurality of prongs 316 having an inner face 322 extend upwardly and slightly outwardly. Setting 310 also includes a band 318 approximately midway between the perimeter 314 of base 312 and upper prong surface 317 of prongs 316. Inner face 322 of prongs 316 have a substantially smooth surface interrupted by a step 296, which functions as the seat or part of the seat of the setting. Thus, setting 310 includes steps 296 directly molded into inner surface 322 of prongs 316 at upper end 320. Upper ends 320 of prongs 316 also have a substantially smooth, flat, or planar inner surface 325 above step 324.

Figure 1:
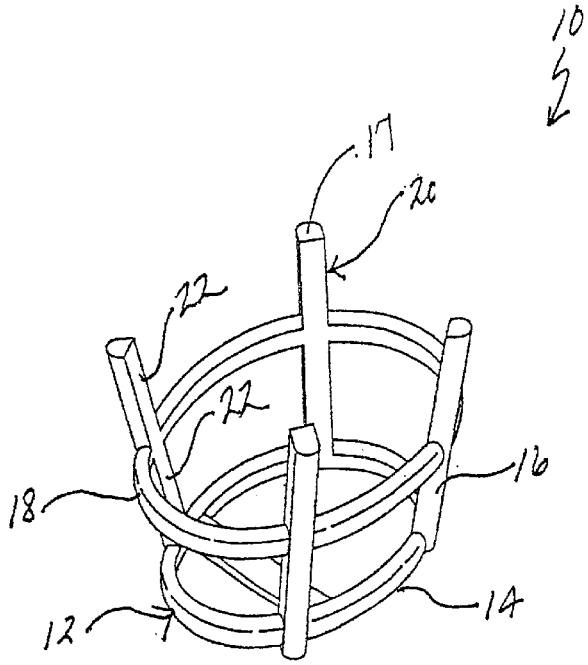
FIG. 1 (PRIOR ART)
FIG. 1 is a perspective view of a typical setting.
Figure 2:
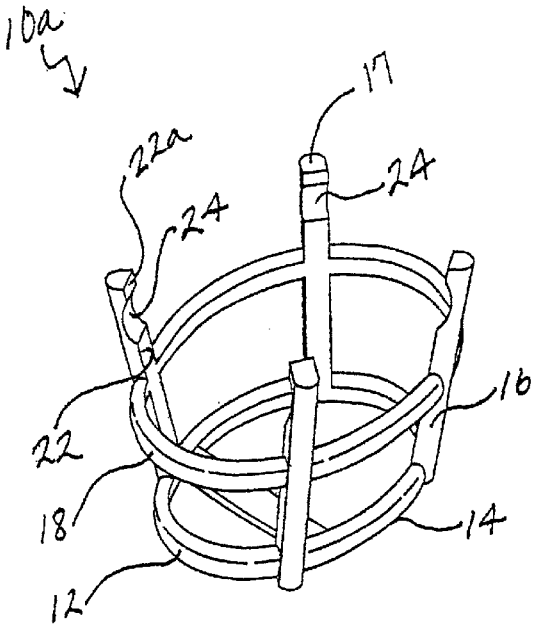
FIG. 2 (PRIOR ART)
FIG. 2 is a perspective view of the setting of FIG. including hand-carved seats.
Figure 3:
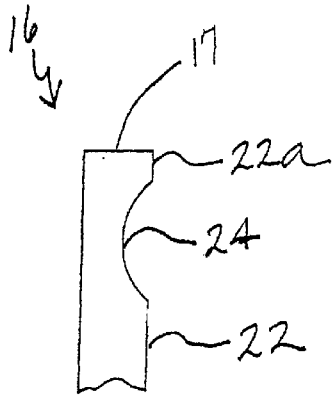
FIG. 3 (PRIOR ART)
FIG. 3 is a cross-section of a portion of a prong of the setting shown in FIG. 2, showing the seat.
Figure 4:
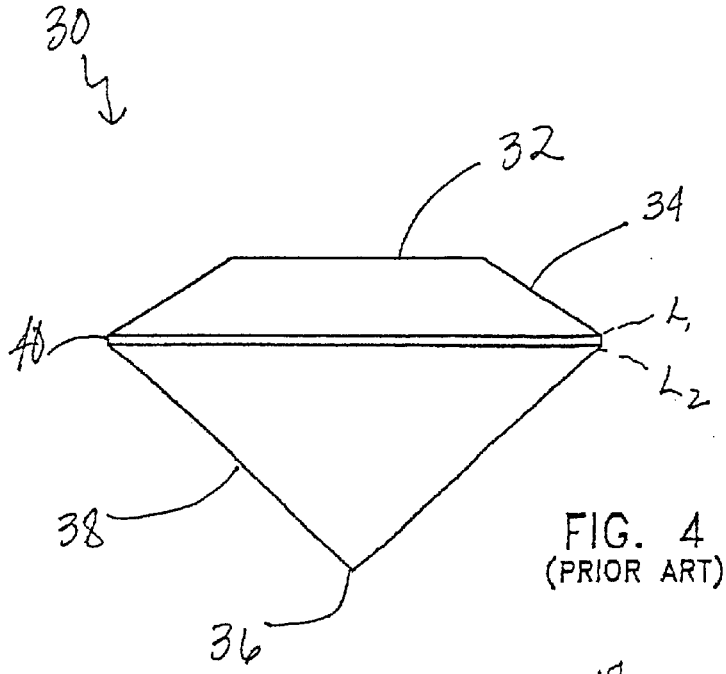
FIG. 4 (PRIOR ART)
FIG. 4 is a side view of a typical gem that might be used in any of the settings illustrated herein showing the various parts of a gemstone.
Figure 5:
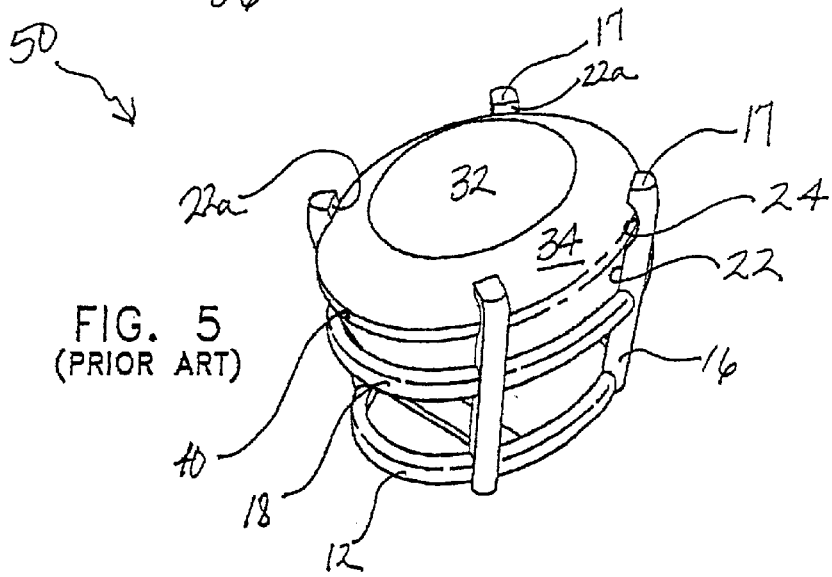
FIG. 5 (PRIOR ART)
FIG. 5 shows the gem of FIG. 4 set into the setting of FIG. 2.
Figure 6:
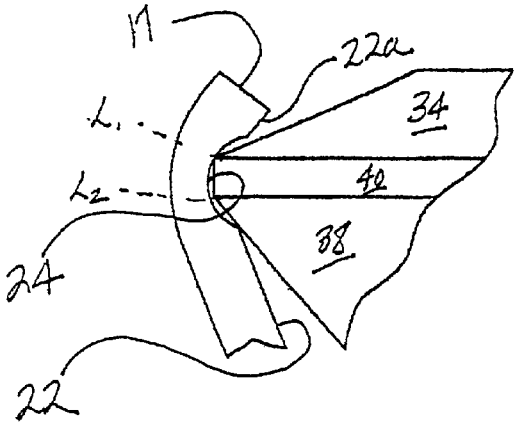
FIG. 6 (PRIOR ART)
FIG. 6 is an expanded side view of a portion of the set gem FIG. 5 illustrating the engagement of the girdle and crown of the gem with the seat and upper end of the prong.
Figure 7:
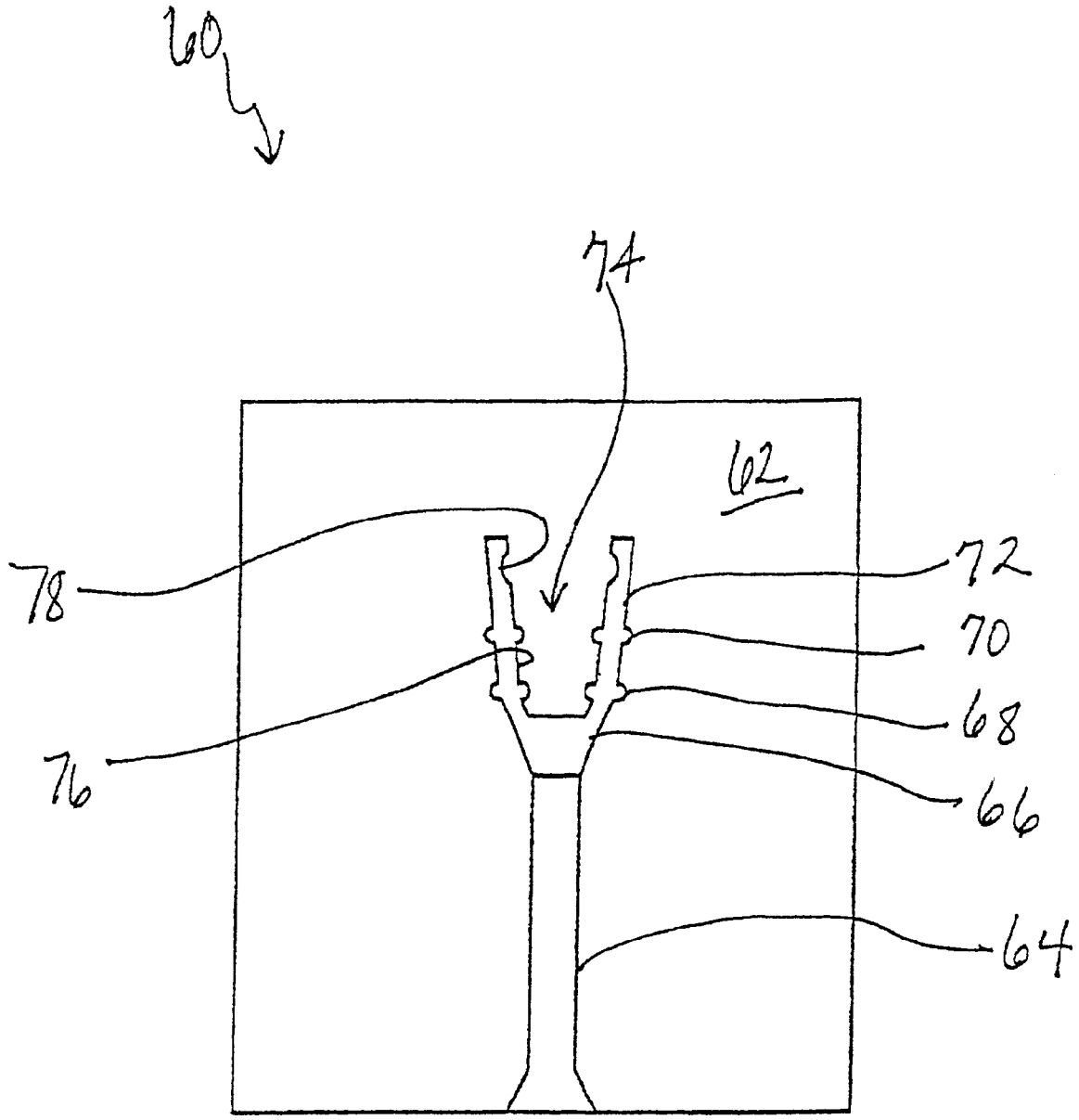
FIG. 7 is a side view of one halve of a rubber mold.
Figure 22:
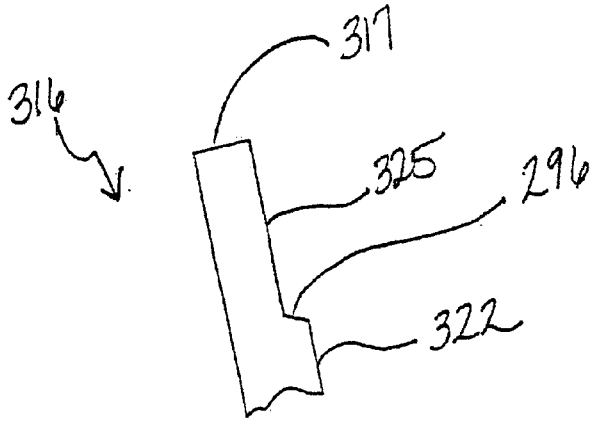
FIG. 22 is a cross-section of a portion of a prong of the setting shown in FIG. 21, showing the seat.

FIG. 22 illustrates an expanded side view of seat 296, showing inner surface 322 of prong 316 below step 296. Unlike settings obtained by hand-carving seats, the present setting does not include an exposed portion of prong 316 above seat 296 (i.e., portion 22*a* in FIG. 1). Instead, surface 325 of prong 316, which is disposed above step 324, is substantially flat and smooth from step 296 to upper prong surface 317. Moreover, the thickness of prong 316 at upper end 320 is substantially the same from step 324 to upper prong surface 317.

Figure 23:
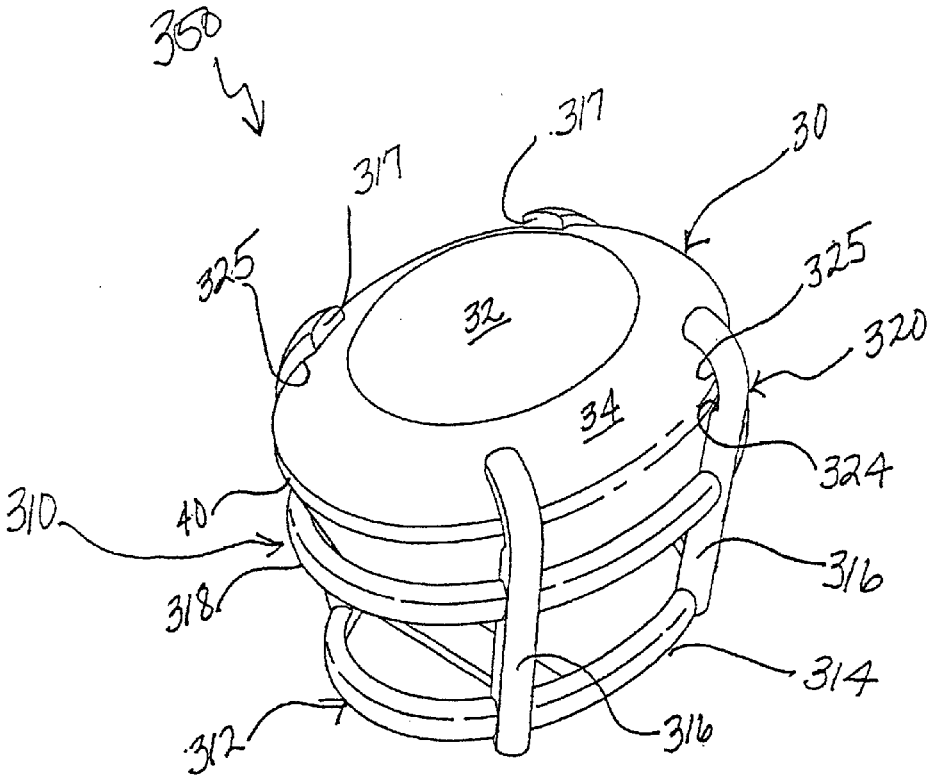
FIG. 23 shows the gem of FIG. 4 set into the setting of FIG. 21.

FIG. 23 shows a perspective view of a set gem 350 using, for example, gem 30 and setting 310. As shown, girdle 40 of gem 30 is supported on step or seat 324. Surface 325 of upper end 320 of prongs 316 substantially conforms to crown 34 and girdle 40 of gem 30. Thus, because surface 325 does not include exposed portions above seat 324, the entire inner surface 325 as well as seats 324 of prong 316 may directly contact girdle 40 and crown 34 of gem 30. Moreover, because prongs 316 are substantially flat and smooth above step 296, the folding process does not require excessive force to bend or fold the prongs toward the crown of the gem, resulting in substantially less shattering of gems during the setting process.

Figure 24:
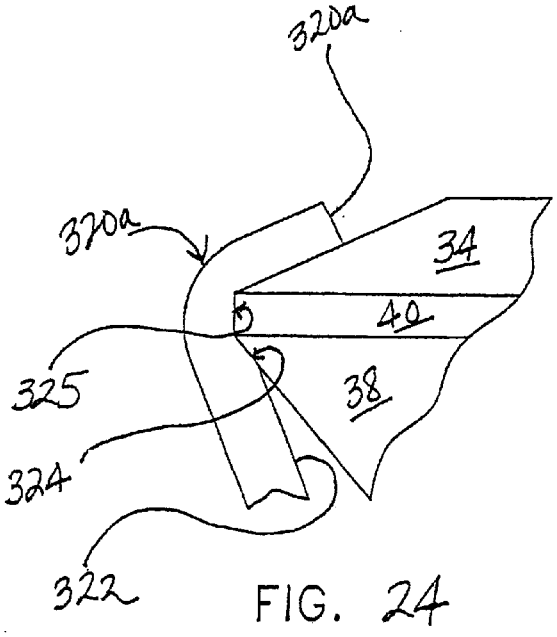
FIG. 24 is an expanded side view of a portion of the set gem of FIG. 23 illustrating the engagement of the girdle and crown of the gem with the seat and upper end of the prong.

A portion of set gem 350 is shown in enlarged view in FIG. 24 to better illustrate the conformance of step 324 and inner surface 325 of prongs 316 of the present settings to girdle 40 and crown 34 surfaces of gem 30. Using the present settings, it is possible to ensure the substantially horizontal position of gem 30 relative to base 312 of setting 310. Moreover, due to the substantially smooth, flat, inner surface 325 of prongs 316 above step 296, the amount of pressure required to bend prongs 316 to conform to girdle surface 40 and crown surface 34 of gem 30 is substantially reduced in comparison to the force required when performing the same procedure using a setting into which the seats are arcuate, such as with hand-carved seats. It has also been unexpectedly discovered that the strength of the set gems obtained using the present settings substantially exceeds the strength of set gems obtained using other methods. It is thought that the increased strength of the present set gems may be due in part to the substantially increased surface area between the interior of the prongs and the surface of the gems.

Thus, those of skill in the art will recognize that the present method provides set gems with superior strength in comparison to other methods. The present seat structure is different from the seat structures that are produced by stamping rubber molding or hand carving. The present gemstone setting provides a highly reproducible method for reproducing a master gemstone setting. The method provides high reproducibility, both of the entire structure and of the position of the seats on the individual prongs.

Although the prongs 316 of the present setting are illustrated herein with a "step," those of skill in the art will recognize that the core molds may be machined to have any shape desired and therefore, core pins having surfaces other than as illustrated may be obtained.

Although particular embodiments of the invention have been described in detail for purposes of illustration, various changes and modifications may be made without departing from the scope and spirit of the invention. All combinations and permutations of the settings and methods are available for practice in various applications as the need arises. Accordingly, the invention is not to be limited except as by the appended claims. For example, the apparatus and method of the invention may be applied to processes that are presently not practically feasible. Accordingly, the invention is not to be limited except as by the appended claims.

What is claimed is:

1. A method for molding a gemstone setting having a plurality of prongs, using a metal mold, comprising the steps of:

machining a first metal core pin mold;

pressing a soft metal into the first core pin mold to obtain a core pin;

inserting the core pin into a second metal mold;

injecting a fluid non-metal material into the second metal mold;

allowing the non-metal material to harden; and removing the hardened non-metal material from the second mold to obtain a non-metal setting having a unitary seat disposed on the inner surface of each prong of the setting;

wherein the distance between the seat and a base of the setting and the distance between the seat and an end of each prong is substantially the same on each prong.

2. The method of claim 1, further comprising the steps of:

casting the non-metal setting in plaster;

removing the non-metal setting from the plaster to form a plaster mold;

introducing a molten metal into the plaster mold;

allowing the molten metal to harden; and removing a metal setting from the plaster mold to obtain a metal setting having a unitary seat disposed on the inner surface of each prong of the setting.

3. The method of claim 2, wherein each of the prongs further comprises a substantially planar inner surface interrupted by a step and the step, comprises at least a portion of the seat.

4. The method of claim 1, wherein the core pin mold comprises an interior surface defined by a frustum, the interior surface comprising a step disposed a predetermined distance from the base of the frustum.

5. The method of claim 4, wherein the step of pressing a soft metal into the core pin mold involves forming a core pin having a handle portion and a frustum extending from the handle portion, the frustum having an outer surface interrupted by a continuous step disposed about the frustum, the step being a predetermined distance from the base of the frustum.

6. The method of claim 5, wherein the step is substantially perpendicular to the outer surface of the frustum.

7. A method for molding a gemstone setting having a plurality of prongs, using a metal mold, comprising the steps of:

machining a first metal core pin mold;

pressing a soft metal into the first core pin mold to obtain a core pin;

inserting the core pin into a second metal mold;

injecting a fluid non-metal material into the second metal mold;

allowing the non-metal material to harden;

removing the hardened non-metal material from the second mold to obtain a non-metal setting having a unitary seat disposed on the inner surface of each prong of the setting;

casting the non-metal setting in plaster;

removing the non-metal setting from the plaster to form a plaster mold;

introducing a molten metal into the plaster mold;

allowing the molten metal to harden; and removing a metal setting from the plaster mold to obtain a metal setting having a unitary seat disposed on the inner surface of each prong of the setting;

wherein the distance between the seat and a base of the setting and the distance between the seat and an end of each prong is substantially the same on each prong.

8. The method of claim 7, wherein each of the prongs further comprises a substantially planar inner surface interrupted by a step, and the step comprises at least a portion of the seat.

9. The method of claim wherein 7, the core pin mold comprises an interior surface defined by a frustum, the interior surface comprising a step disposed a predetermined distance from the base of the frustum.

10. The method of claim 9, wherein the step of pressing a soft metal into the core pin mold involves forming a core pin having a handle portion and a frustum extending from the handle portion, the frustum having an outer surface interrupted by a continuous step disposed about the frustum, the step being a predetermined distance from the base of the frustum.

* * * * *